US010682618B2

(12) United States Patent
Atalla et al.

(10) Patent No.: US 10,682,618 B2
(45) Date of Patent: Jun. 16, 2020

(54) SYSTEM AND METHOD FOR CHARACTERIZING CONDITIONS IN A FLUID MIXING DEVICE

(71) Applicant: GENERAL ELECTRIC COMPANY, Schenectady, NY (US)

(72) Inventors: Ashraf Said Atalla, Clifton Park, NY (US); Klaus Gebauer, Uppsala (SE); Sima Didari, Schenectady, NY (US)

( * ) Notice: Subject to any disclaimer, the term of this patent is extended or adjusted under 35 U.S.C. 154(b) by 460 days.

(21) Appl. No.: 15/166,397

(22) Filed: May 27, 2016

(65) Prior Publication Data

US 2017/0341043 A1 Nov. 30, 2017

(51) Int. Cl.
*B01F 15/00* (2006.01)
*B01F 13/08* (2006.01)

(52) U.S. Cl.
CPC .... *B01F 15/00201* (2013.01); *B01F 13/0827* (2013.01); *B01F 15/0048* (2013.01); *B01F 15/00233* (2013.01); *B01F 15/00246* (2013.01); *B01F 15/00389* (2013.01); *B01F 2215/0032* (2013.01)

(58) Field of Classification Search
CPC ..... B01F 15/00201; B01F 15/00246; B01F 15/00389; B01F 15/0048; B01F 13/0827
USPC ..... 366/273
See application file for complete search history.

(56) References Cited

U.S. PATENT DOCUMENTS 2,990,256 A 6/1961 Lovins
4,594,883 A * 6/1986 Pollard ..... B01F 15/00201 73/54.23
5,259,670 A 11/1993 Brown
7,743,674 B2 6/2010 Boncan et al.
8,024,962 B2 9/2011 Tonmukayakul et al.
8,885,035 B2 11/2014 Ludwig
2002/0082173 A1 6/2002 Terentiev
(Continued)

FOREIGN PATENT DOCUMENTS

WO 2009132874 A2 11/2009
WO WO-2010082817 A2 * 7/2010 ..... B01F 13/002

OTHER PUBLICATIONS

G Rezazadeh et al., "Simultaneous measurement of fluids viscosity and density using a microbeam", Perspective Technologies and Methods in MEMS Design, 2009. MEMSTECH 2009. 2009 5th International Conference on, pp. 36-44, Apr. 22-24, 2009, Zakarpattya.
(Continued)

*Primary Examiner* — Marc C Howell
(74) *Attorney, Agent, or Firm* — Culhane Meadows PLLC; Jeff B. Vockrodt

(57) ABSTRACT

Embodiments of the method disclosed regard use of a torque sensor (e.g., transducer) and using the measured torque to detect the different fluid and mixing properties, conditions, and abnormalities in a mixing process. The torque produced in the mixing process relates to different fluid properties such as viscosity and density. It also relates to different mixing conditions such as presence of obstacles and changes or issues with gas sparging. Moreover, torque measurements enable determination of power transmitted to fluid by actual measurement, in contrast to using solely empirical impeller power number and speed, and allowing for actual mass transfer determination (i.e., gas transfer calculations).

28 Claims, 12 Drawing Sheets

(56) References Cited

U.S. PATENT DOCUMENTS

| | | | | |
|---|---|---|---|---|
| 2002/0145940 | A1 | 10/2002 | Terentiev | |
| 2004/0047232 | A1 | 3/2004 | Terentiev | |
| 2009/0104594 | A1 | 4/2009 | Webb | |
| 2012/0149091 | A1 | 6/2012 | Wilkerson et al. | |
| 2013/0301375 | A1* | 11/2013 | Stephan | B29B 7/007 366/76.2 |
| 2014/0157876 | A1 | 6/2014 | Anderson et al. | |
| 2016/0047184 | A1* | 2/2016 | Luharuka | B01F 15/00201 166/250.01 |
| 2017/0216798 | A1* | 8/2017 | Boettcher | B01F 3/1221 |

OTHER PUBLICATIONS

B Jakoby et al., "Miniaturized sensors for the viscosity and density of liquids-performance and issues", IEEE Transactions on Ultrasonics, Ferroelectrics, and Frequency Control, vol. 57, Issue: 1, pp. 111-120, Jan. 2010.

* cited by examiner

SYSTEM AND METHOD FOR CHARACTERIZING CONDITIONS IN A FLUID MIXING DEVICE

FIELD

Embodiments relate generally to the characterization and monitoring of a mixing process; more particularly, embodiments are drawn to characterization of conditions, without limitation, to include measurement of torque and speed, in a fluid mixing device.

BACKGROUND

Mixing systems often include an agitator or impeller mechanically connected to a drive shaft lowered into a fluid through an opening in the top of a vessel. The drive shaft connects to an electric motor arranged outside the vessel. In a closed vessel, a fluid seal is provided between the drive shaft and the wall of the vessel to prevent leakage of fluid from the vessel. Other mixing systems include a rotating magnetic drive head outside of the vessel and a rotating magnetic impeller as an agitation element within the vessel. The movement of the magnetic drive head enables torque transfer and thus rotation of the magnetic impeller allowing the impeller inside the vessel to mix and agitate the fluid within the vessel without providing a sealed shaft. The magnetic mixing principle is especially advantageous when using completely closed vessels, or when utilizing containers as required to maintain sterility of the internal volume and the fluid to be mixed.

In single-use processing technology, as employed in the production of biopharmaceuticals, plastic containers and bags are used which are typically pre-sterilized (e.g., by gamma irradiation), and employed as completely closed systems connected to adjacent fluid processing equipment and lines using aseptic connections. In these applications of single-use mixing vessels and bioreactors, the use of magnetic mixing technology is preferred for reasons of process safety, simplicity and the lower cost that comes by omitting complex sealing arrangements around rotating shafts.

Today, certain challenges are imposed on processes employing magnetic mixing technology where a direct and permanent mechanical connection between impeller and external drive by a shaft is lacking. These deficiencies include not knowing the actual speed of the impeller; and the torque and power input are more difficult to assess compared with a direct mechanical coupling. Further, as the power transferred by magnetic couplings is generally limited compared to mechanical shafts, magnetic mixers are typically operating at lower power input which makes it difficult to assess power input and torque on the background of frictional forces, disturbances and noise in such measurements. Therefore, there is a need to improve the assessment, measurement and control of magnetic mixing and magnetic mixer couplings.

In more details, challenges with current magnetic mixers include: (1) indirect (not real-time) determination of power delivered to the fluid, as performed with user-interface manipulation of formulas or look-up tables; (2) fluid density and/or viscosity changes as the mixing process takes place, without accurate control of the mixing process; and (3) inability to identify abnormalities in the mixing process. No feature or direct process in bioreactors used to date can detect or flag such issues.

Moreover, no existing solution provides for a direct measure of the power delivered to the fluid while mixing.

Prior methods have been dependent on look-up tables to calculate the power delivered to fluid. In addition, no device or method has been able to continuously monitor the fluid viscosity and density or to detect abnormalities in mixing process without the look-up tables as suggested prior.

It is desirable to address the needs as stated above by providing additional functionality to a bioreactor and/or mixer. It will allow accurate monitoring of the power delivered to the fluid while mixing, and will provide more accurate control by a user. It will also beneficially permit continuous updates of the fluid properties, and preferentially, alarms in cases of abnormalities in mixing, such as, for example, in the circumstance of 'flooding' of impellers when the ratio of volumetric gas to liquid ratio exceeds a threshold.

SUMMARY

Embodiments of the invention disclose a system and method that utilize a torque sensor, and the measured torque associated with the sensor, to detect the different fluid and mixing properties, conditions, and abnormalities in a mixing process. The torque produced in the mixing process relates to different fluid properties such as viscosity and density. It also relates to different mixing conditions such as presence of obstacles and changes or issue with gas sparging. Moreover, torque measurements enable determination of power transmitted to a fluid by actual measurement, in contrast to using solely empirical impeller power number and speed, and allow actual mass transfer determination (i.e., gas transfer calculations).

Embodiments disclosed regard a torque sensor (e.g., transducer) and a method of using the measured torque to detect the different fluid and mixing properties, conditions, and abnormalities.

In one embodiment, a magnetic mixing system characterizes conditions in a fluid mixing device, the system comprising: a vessel comprising a fluid; a drive that creates a magnetic field; a controller that operates the drive; one or more sensors positioned with the system to detect the magnetic field or a magnetic flux; and a processor receiving information from the sensors to calculate one or more of power provided to the fluid, torque and speed of the impeller. The magnetic mixing system further comprises an impeller inside the vessel, wherein the drive creates the magnetic field to rotate the impeller and the sensors measure the magnetic field or the magnetic flux provided to the impeller. The one or more sensors are positioned with the drive, the impeller, or between the impeller and the drive. The sensors can further detect current and voltage provided to the drive.

In one aspect, the drive as a stator, or the drive can include a set of permanent magnets in combination with a motor. In another aspect, the drive is a stator, motor, or magnetic coupling, and the sensors are transducers positioned therewith, respectively, alone or in combination.

Embodiments of the application, utilize the torque and speed of the impeller as it corresponds to torque and speed in mixing of the fluid. The processor uses the power, torque or speed, alone or in combination, with one or more fluidic properties to assess real-time mixing conditions and mixing properties. In addition, the processor detects a change in the fluidic properties, mixing conditions, or mixing properties, individually or in combination. In another embodiment, the processor detects abnormalities in the fluidic properties, mixing conditions, or mixing properties as determined by learned patterns or predetermined threshold values. The fluidic properties include any number of characteristic compositions, including density and viscosity of the fluid, among others. The processor detects abnormalities in the density or viscosity of the fluid, in the power, torque, or speed, alone or in combination. Further, the processor can detect blockage, gas dispersion, or one or more contaminants in the fluid, alone or in combination.

Embodiments disclosed herein provide a processor that is an analyzer to provide direction to the controller in a feedback loop. The analyzer directs power to the drive to increase or decrease agitation, to adjust fluidic properties, and correct any deficiencies or abnormalities, individually or in combination.

Thus described, one embodiment discloses a method of controlling conditions in a fluid mixing device, the method comprising the steps of: providing the fluid mixing device having a vessel comprising a fluid, a drive that creates a magnetic field, a controller that operates the drive, one or more sensors, and a processor; detecting, by way of the one or more sensors, at least one of a magnetic field, a magnetic flux, power provided to the fluid, torque, speed, current, or voltage; calculating power, torque and speed of the impeller, if not previously detected; and analyzing, by way of the processor, using the power, torque and speed to determine one or more fluidic properties of the fluid, real-time mixing conditions and mixing properties. In one aspect, the mixing system further comprises an impeller and the step of detecting includes detecting a position of the impeller. The step of analyzing includes detecting a change in the fluidic properties.

In addition, the power, torque, speed, current, voltage, fluidic properties, mixing conditions, and mixing properties, alone or in combination, are displayed at a user-interface. The power, torque and speed are determined directly, without user manipulation.

Aspects of the disclosed embodiments include fluidic properties comprising fluid composition, density, and viscosity, alone or in combination, provided to the processor by way of the sensors. The method further comprises a step of identifying abnormalities in the fluid mixing device, the fluidic properties, the mixing conditions, and the mixing properties. The processor can be an analyzer that provides feedback to the controller to automatically control the power, torque, and speed delivered to the drive. In one aspect, the processor provides a pre-determined composition, viscosity and density of the fluid, alone or in combination. In another aspect, the processor provides information to the controller that determines an optimal composition, viscosity, and density as based on a change in the fluidic properties.

Further aspects allow the sensors to detect any number of attributes, characteristics, or otherwise, including, without limitation, detecting an angle between the drive and the impeller during operation of the fluid mixing device in order to determine the fluidic properties.

Embodiments thus provide additional functionality to a user of the bioreactor or mixer. Accurate monitoring of power delivered to the fluid while mixing is now possible, in real-time, allows continuous updates and adjustments as to the fluid properties. In another aspect, alarms are implemented, as desired, in cases of abnormalities in the mixing process.

DETAILED DESCRIPTION

Figure 1:
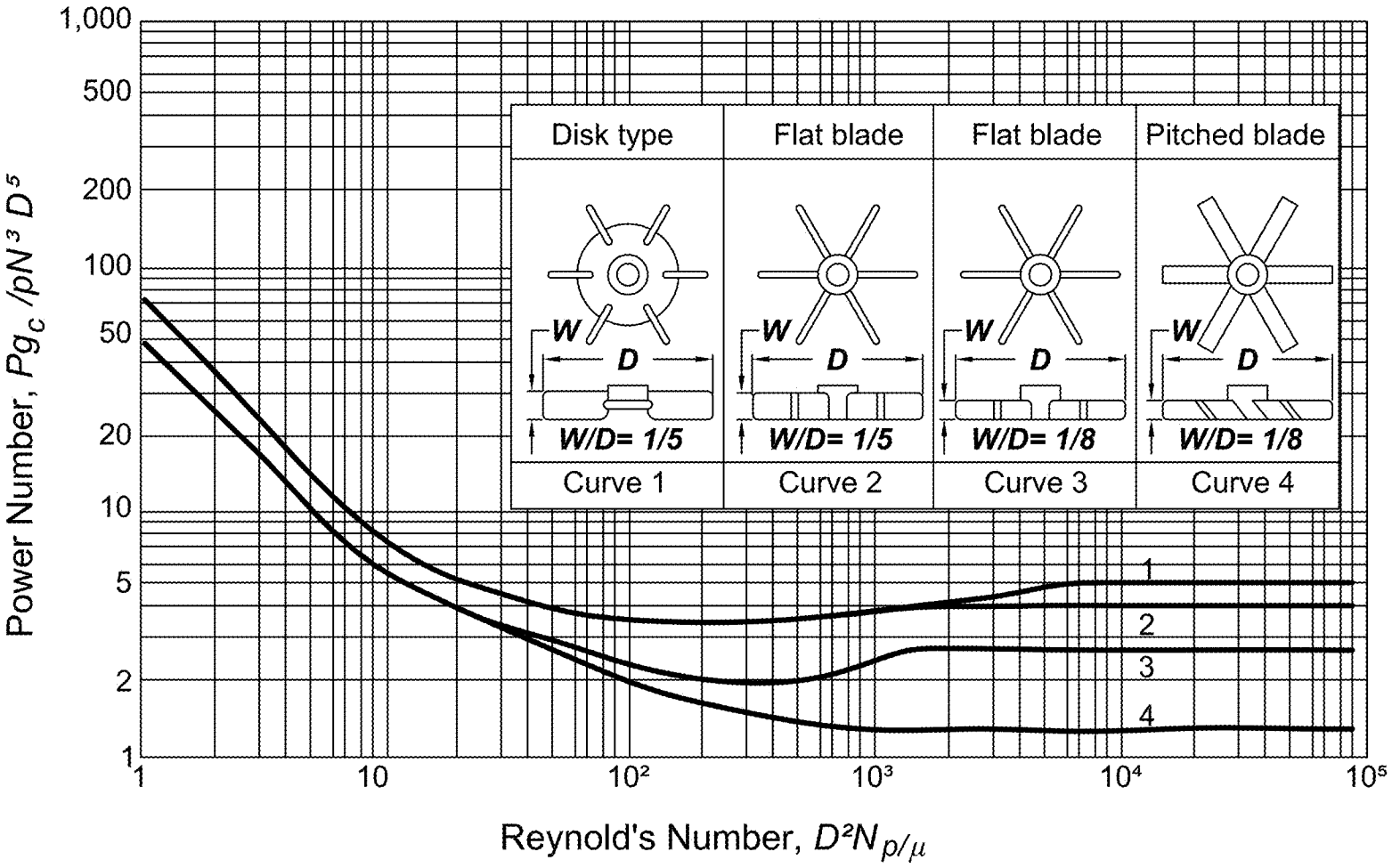
FIG. 1 is an illustration that demonstrates as the Reynolds Number decreases, a point is reached where the power number begins to increase sharply, as dependent on the type of impeller utilized.

Various embodiments will be better understood when read in conjunction with the appended drawings. It should be understood that the various embodiments are not limited to the arrangements and instrumentality shown in the drawings.

Torque produced in the mixing process relates to different fluid properties such as viscosity and density. Torque also relates to different mixing conditions such as presence of obstacles and changes or issue with gas sparging. For example, disruption of the continuous liquid or sparger liquid by zones of air presents large bubbles or channels, a behavior typically called [gas] flooding of the mixer; this leads to a drastic reduction of power input. A torque measurement (i.e. a continuous measurement in real time) under conditions close to or at the point of flooding of the mixer allows for better process control and higher utilization of mixing power, including improved capacity and capability in the process step. For example, a bioreactor could operate at higher mass transfer and thus higher productivity. Moreover, torque measurements, along with speed, enable determination of power transmitted to fluid by actual measurement, in contrast to using solely empirical impeller power number and speed, and thus allow actual mass transfer determination (i.e., gas transfer calculations). As described herein, embodiments refer to a torque and speed sensor, such as a transducer, and a method of using the measured torque and speed to detect the different fluid and mixing properties, conditions, and abnormalities.

Mixing Power

Embodiments of the invention disclosed allow the power consumed by a rotating impeller to be easily measured in a process fluid. The units express this power as 'horsepower' (HP). Mixer performance relates to horsepower; problems, however are associated with this tendency. In general, Power (P) input to the fluid can be calculated for typical mixers (turbulent flow) applications as follows:

$$P = \frac{\rho N_p N^3 D^5}{g_c} \quad \text{(Eq 1)}$$

ρ=Specific Gravity $N_9$=Power Number of Impeller

N=Impeller Speed

D=Impeller Diameter $g_c$=dimensional constant

Viscosity Effect

As viscosity increases, the impeller power number may begin to increase. This becomes important in the HP calculations because as power number begins to go up so does the horsepower utilized to drive the mixer. Simply increasing the input [horse-] power may be the answer, but this change reduces the service factor of the mixer drive, hence a 'bigger' mixer may be required. Viscosity increase also affects the flow characteristics of fluid as compared to water.

Reynold's Number

Reynolds Number is a dimensionless number that can be derived as follows:

$$N_{re} = \frac{D^2 N \rho}{\mu} \quad \text{Eq (2)}$$

ρ=Fluid Density

μ=Viscosity

The power number ($N_p$) is constant for each impeller type, as long as the Reynolds number is sufficiently high. The power number is a function of Reynolds Number ($N_{re}$).

The illustration of FIG. 1 shows how the power number for each impeller varies with changes in Reynolds Number. As the Reynolds Number drops, a point is reached where the power number begins to increase sharply. This point depends on the type of impeller in use. Reynolds Numbers or $N_{re}$ between 1000 and 2000 are generally considered "in transition".

Figure 2:
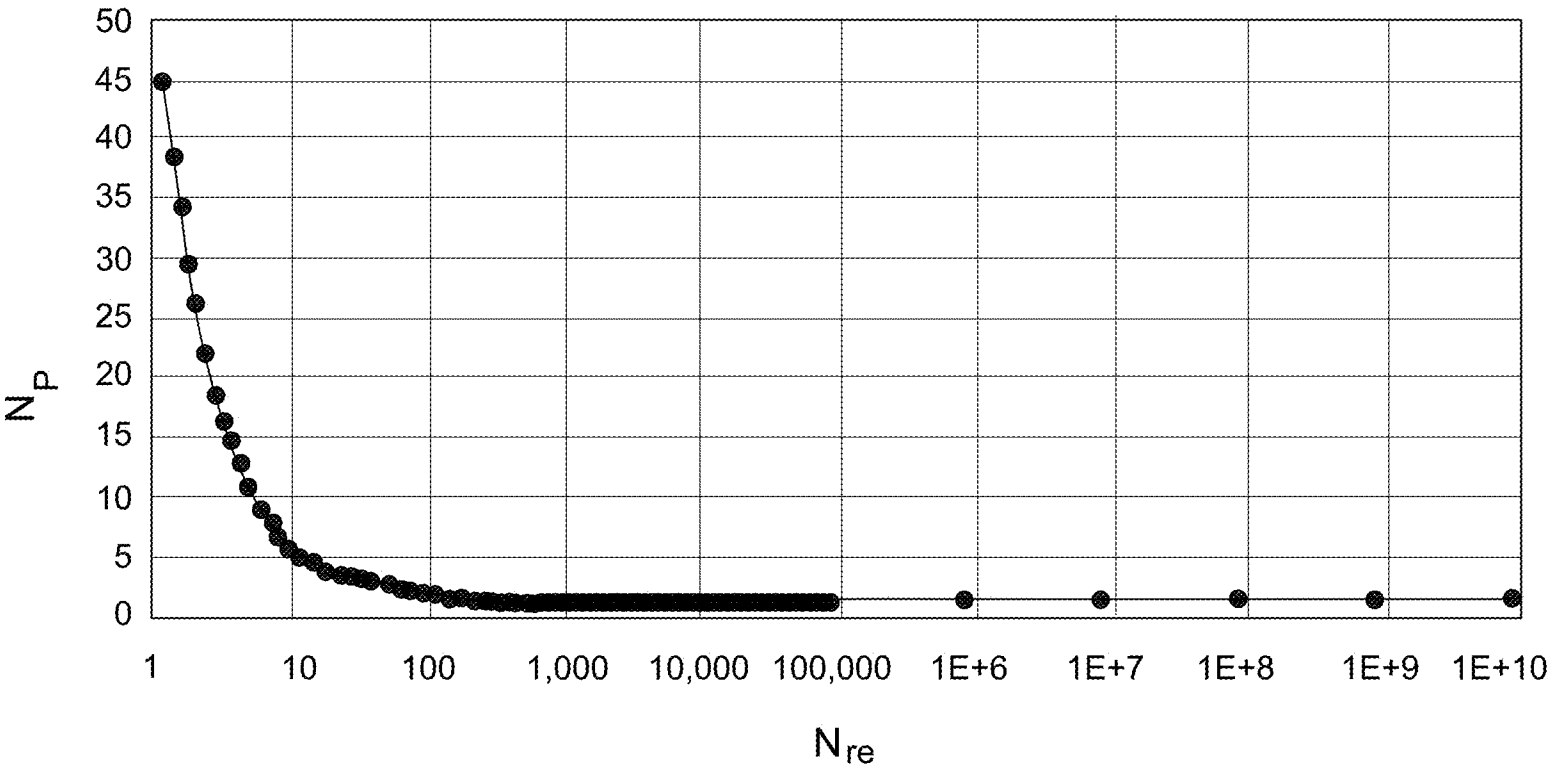
FIG. 2 charts power number, $N_p$, versus Reynolds Number, $N_{re}$.

The Reynolds number is the indicator of the type of mixing fluid in which the mixer will operate. If the Reynolds Number is above 2,000, the power number is constant, When the Reynolds Number calculated is less than 1,000 (i.e., laminar flow), then the power number increases as the Reynolds Number decreases. Consequently, the shaft horsepower calculated is based on the corrected power number. In this case, as shown in FIG. 2, a power number ($N_p$) vs Reynolds Number ($N_{re}$) curve is obtained from the impeller manufacturer or by experimentation.

In embodiments of the invention, the power utilized to mix a fluid at a given speed can vary based on multiple parameters, including but not limited to: (i) the impeller diameter, (ii) the impeller blade design, (iii) the fluid properties (i.e. viscosity and density). In some applications, such as mammalian cells mixers, controlling the power delivered to the fluid is an element of the mixing process. Since the mixing power is driven by the drive system, it can be measured and controlled from that side. The drive system can be in the form of a stator that rotates the impeller, or a set of magnets coupled to the impeller magnets and driven by a separate motor. In these embodiments, the magnetic field that couples the drive to the impeller depends on the power (and also torque) delivered to the impeller. By measuring the magnetic field or flux, the torque, speed, and power delivered to the impeller can be calculated and hence controlled. Further, the current and voltage inputs to the drive system are related to the power delivered to the system. These values can also be used to calculate the power delivered to the impeller.

Characterizing a Fluid

Fluid properties of density ρ and viscosity μ play a role in specifying the desired mixing power and torque, as these properties are represented in the Reynolds number calculation as well as in the specific power equation. In estimating such parameters, for exemplary purposes, and not limitation, curve #4 from the FIG. 1 is shown in FIG. 2.

Next, the torque-speed curves are plotted for seven different fluids: water, and six other fluids with different density, dynamic viscosity, or combination of both, than water. Table 1 shows the general properties of each fluid while Table 2 shows the impeller and tank properties.

TABLE 1

| Property | Water | Fluid #1 | Fluid #2 | Fluid#3 | Fluid#4 | Fluid#5 | Fluid#6 |
|---|---|---|---|---|---|---|---|
| Fluid Density, ρ [kg/m³] | 1000 | 1000 | 1000 | 1000 | 1100 | 1300 | 1500 |
| DynamicViscosity, μ [Pa · s] | 0.00089 | 0.0089 | 0.089 | 0.89 | 0.00089 | 0.00089 | 0.00089 |

TABLE 2

| Property | Value |
|---|---|
| Impeller Diameter [in] | 3.5 |
| Tank Volume [Lit] | 200 |

Figure 3:
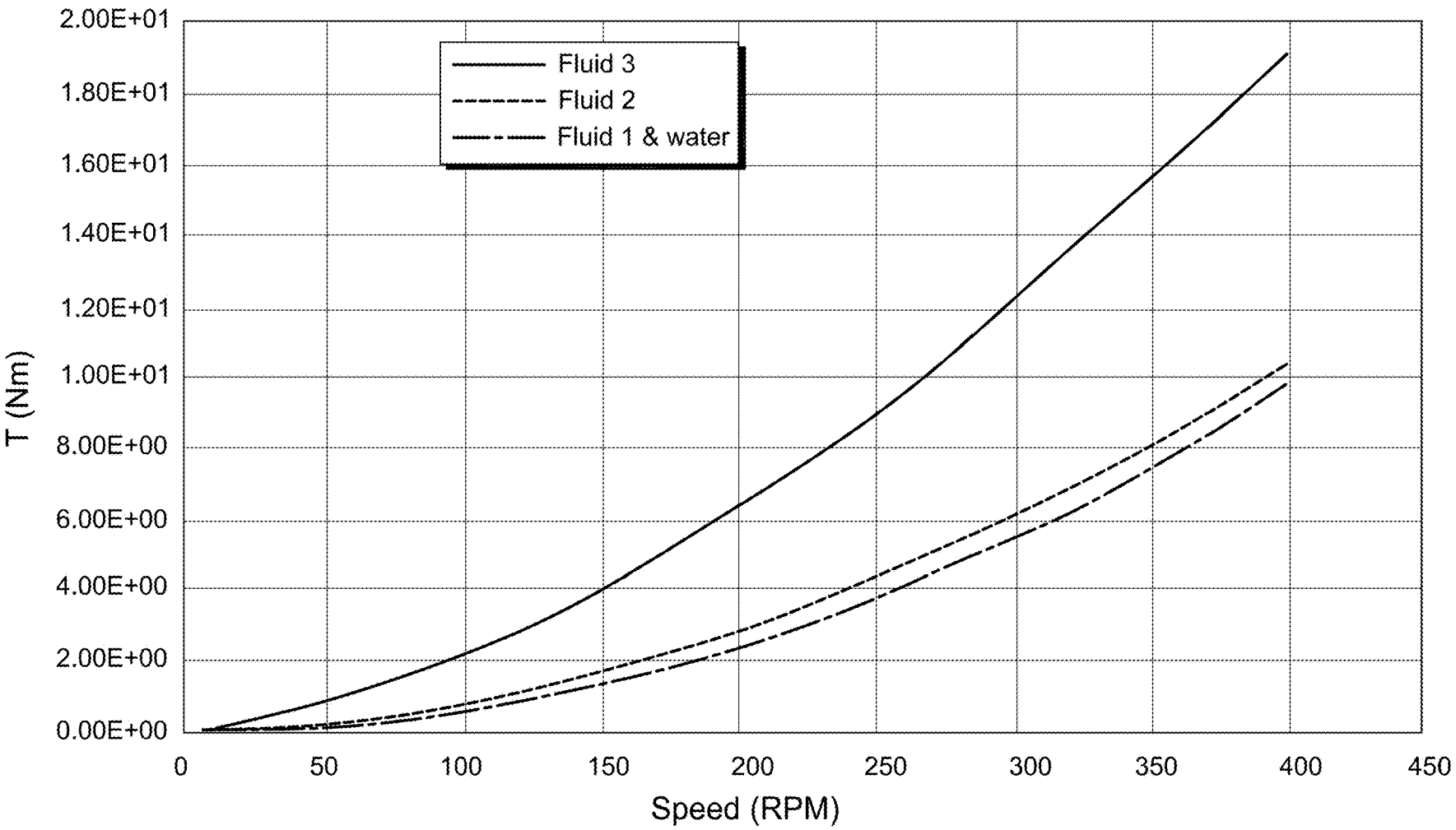
FIG. 3 depicts the variation of impeller torque as a function of rotating speed for Fluids 1, 2, 3, and water.

The calculation for the torque-speed characteristics are done using equation 1 (Eq. 1) and equation 2 (Eq. 2). FIG. 3 shows the variation of impeller torque as a function of rotating speed for Fluids 1, 2, 3, and water. The viscosity is the variable parameter in this calculation. Fluid 1 does not show detectable variation from water, while Fluid 2 and Fluid 3 show differences due to the increase in viscosity (100 times for Fluid 2 and 1000 times for Fluid 3).

Figure 4:
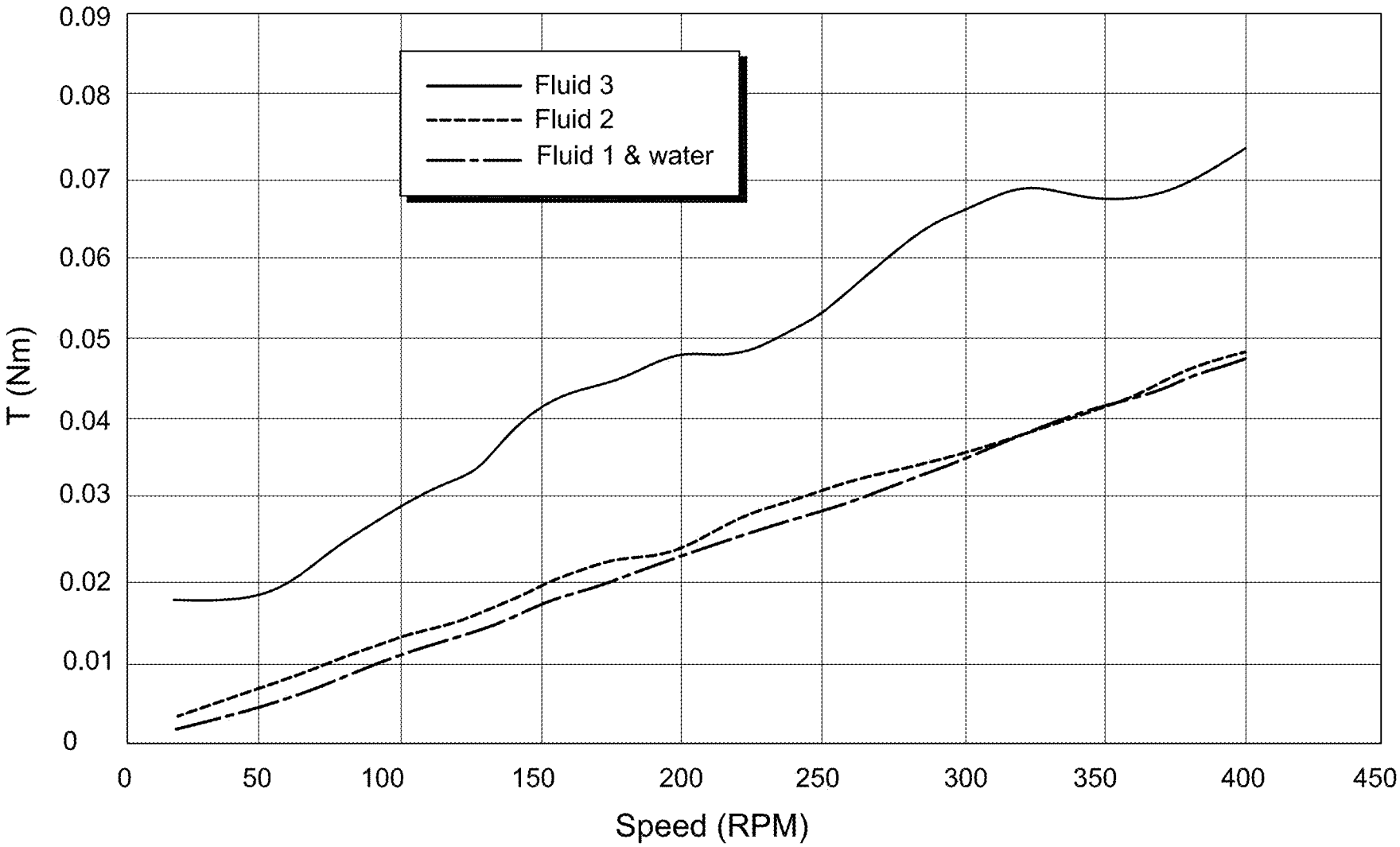
FIG. 4 illustrates the variation in torque-speed slope (dT/dn) for different viscosities, as shown by Fluids 1, 2, 3, and water.

FIG. 4 shows the variation in torque-speed slope for different viscosities. The variation in slope is minimal when varying the viscosity, while the variation in y-axis crossing point is differentiated. Again, Fluids 1, 2, 3, and water are plotted; Fluid 1 does not show detectable variation from water.

Figure 5A:
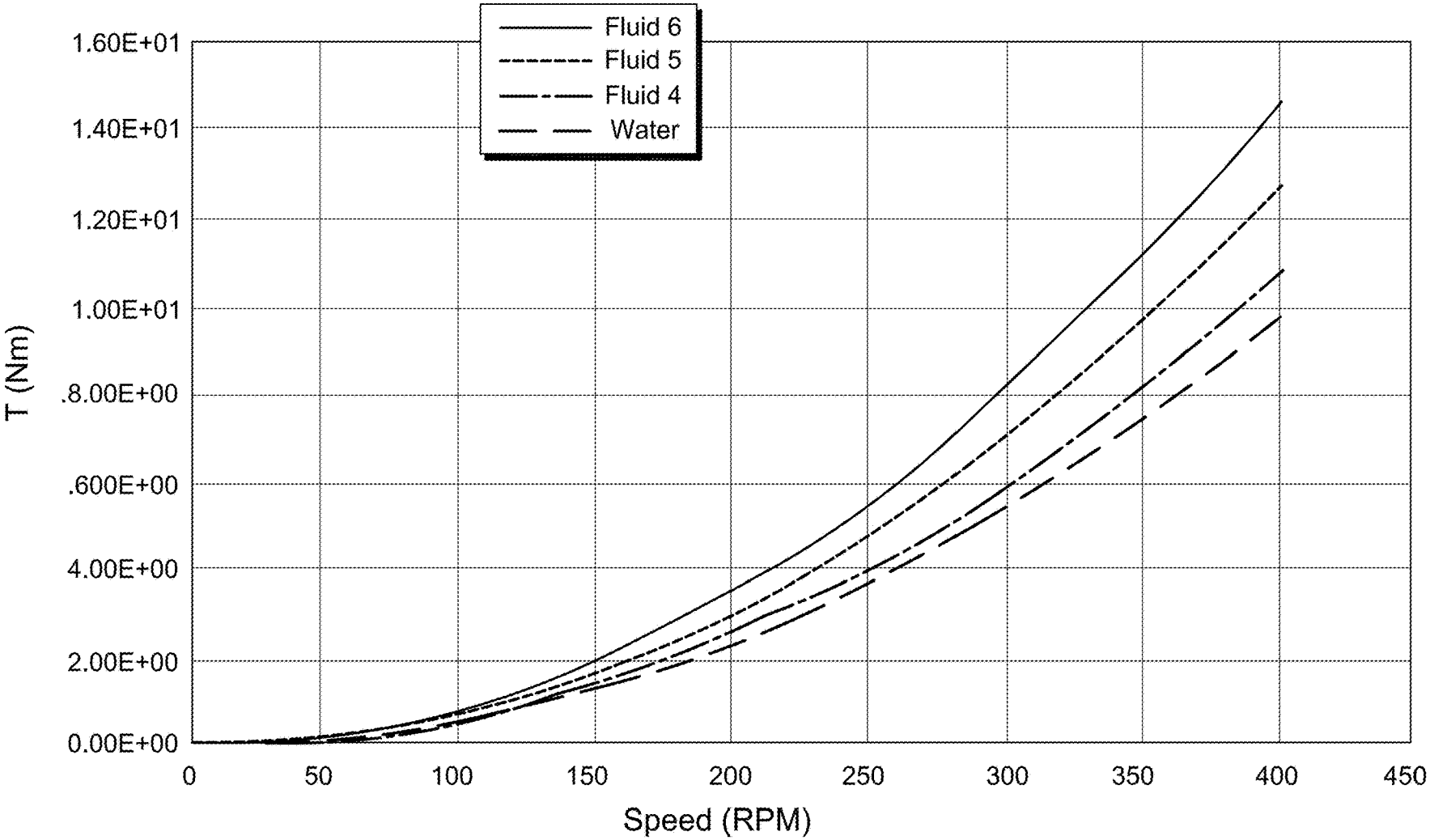
FIG. 5A shows the variation of impeller torque as a function of rotating speed for Fluids 4, 5, 6, and water, whereby the viscosity is kept constant and density is varied to 1.1×, 1.3×, and 1.5×, respectively.

FIG. 5A shows the variation of impeller torque as a function of rotating speed for Fluids 4, 5, and 6 as compared to water. The viscosity is kept constant and density is varied (relative to the density of water) to 1.1×, 1.3×, and 1.5×, respectively. The variation of density is detectable for the fluids.

Figure 5B:
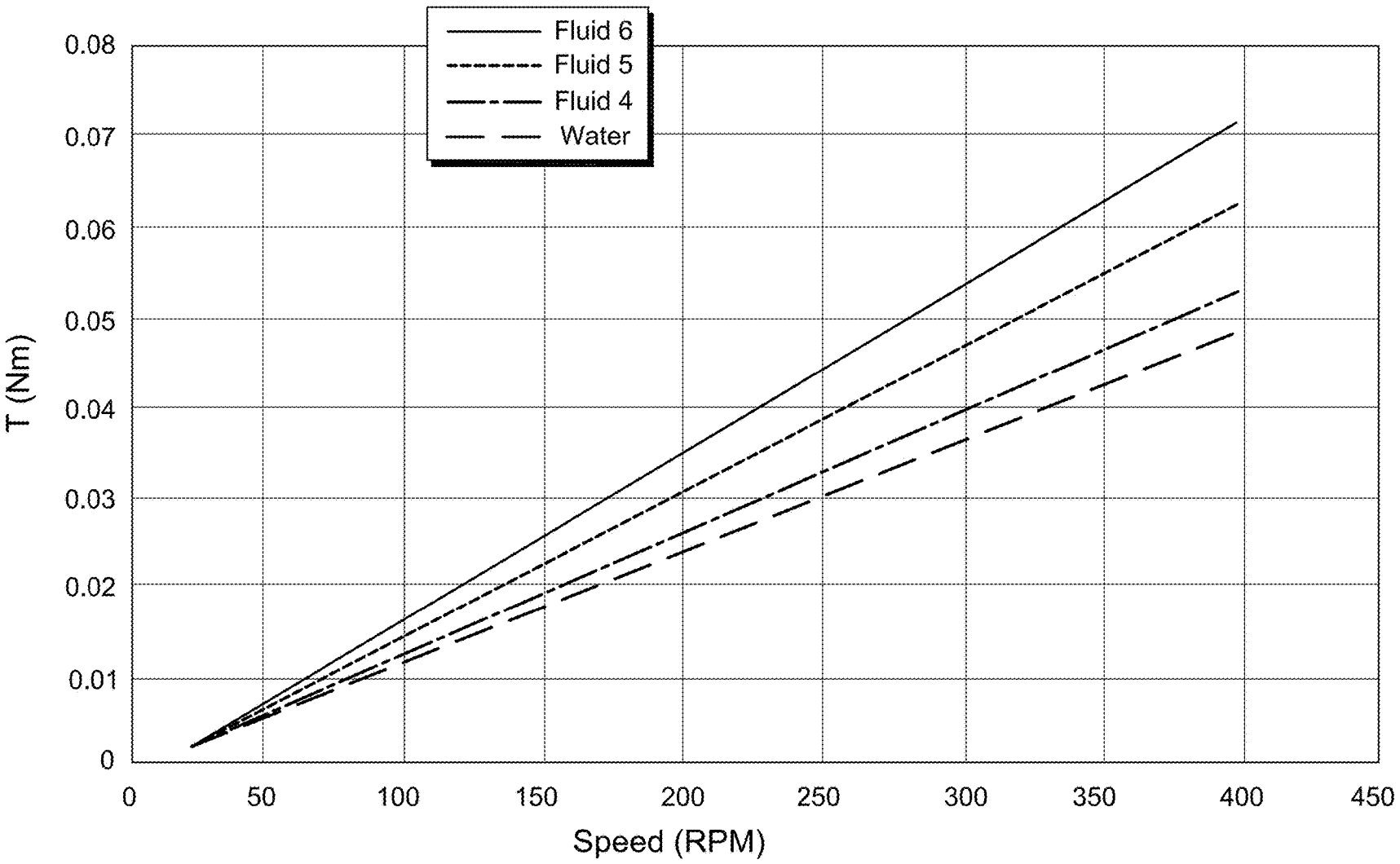
FIG. 5B shows the variation in torque-speed slope for different fluid densities in one embodiment.

FIG. 5B shows the variation in torque-speed slope for different fluid densities of Fluids 4, 5, and 6 as compared to water. While the variation in slope due to viscosity is minimal, the density effects the slope, and minimally, the y-axis intercept.

Hence, following the relationships outlined above, the change of viscosity in a fluid may be detected by measuring the impeller torque at different speeds. In addition, changes in density are detectable at various levels. By studying the torque-speed slope, the variation in fluid properties can be distinguished between variations in viscosity or density.

Embodiments below describe the method of measuring the torque for bioreactors and various types of mixers.

To measure the torque and speed of an impeller, transducers can be installed on the shaft, in the space between the impeller and drive, on the impeller magnets, or on the drive magnet or core as additional components.

Method 1: Measuring Torque and Speed as Related to Magnet-Magnet Coupling

Figure 6A:
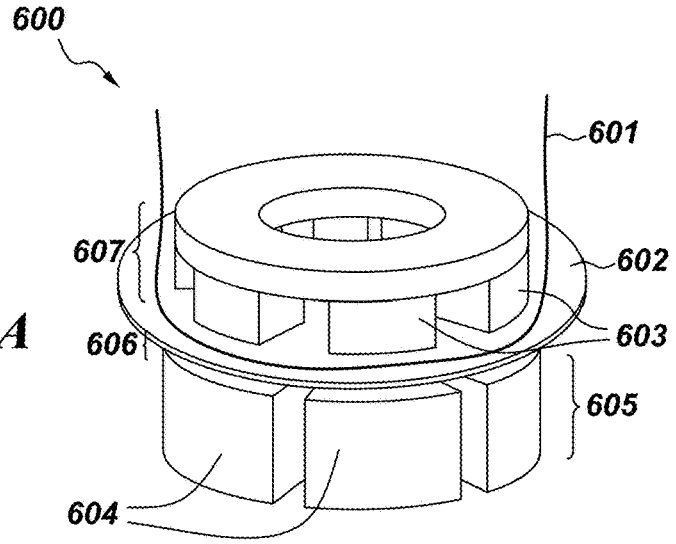
FIG. 6A is a perspective view in one embodiment of a printed circuit board (PCB) winding incorporated between an arrangement of magnets to pick up the back electromotive force (EMF).
Figure 6B:
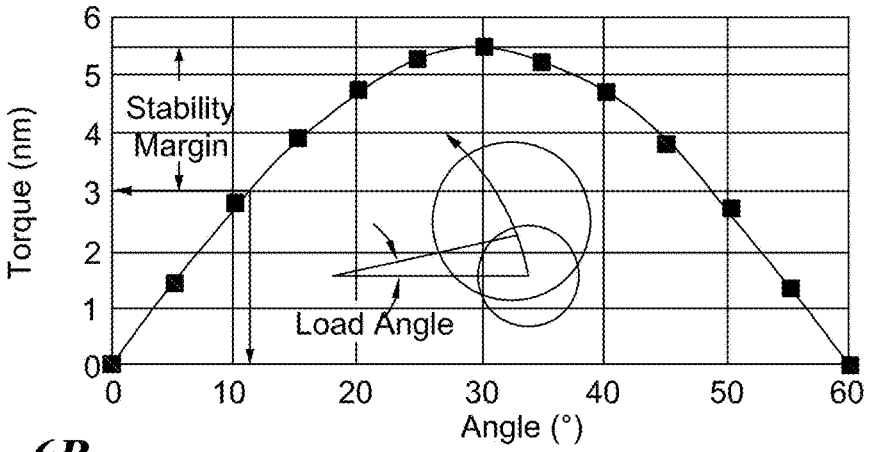
FIG. 6B is a graphical depiction of the torque versus load angle in one embodiment.

Embodiments of the invention include a sensor positioned outside a bag or vessel, outside the closed system, that does not allow for electrical wiring inside the bag. In one aspect, the sensor is integrated with the drive head. FIG. 6A depicts a system 600 with a printed circuit board (PCB) winding 602 incorporated with an arrangement of magnets 603, 604 of an axial flux stator 605. The system 600 includes a first set of magnets 603 at the impeller end 607, the impeller end positioned within a vessel 601, and a second set of magnets 604 positioned at the stator end 605. The PCB winding 602 is a single coil, or set of coils as shown in greater detail of FIG. 6C, and placed between the sets of magnets 603, 604 in the area 606 where the magnetic gradient is arranged. FIG. 6B demonstrates that synchronous torque depends on load angle, such that the angle between the rotor and the stator fluxes (i.e., the angle between the rotor pole (or magnet) and the stator pole (or magnet)). By placing a single coil or a set of coils, such as the printed circuit board (PCB) winding 602, between the stator 605 and the rotor 607, the magnetic flux in the space or area 606 between the drive and the impeller (partially or fully filled with air) can be detected and related to the produced torque. In one aspect, a single coil or the set of coils are printed on a circuit board, and can be arranged and placed in a single layer or multi-layers.

Figure 6C:
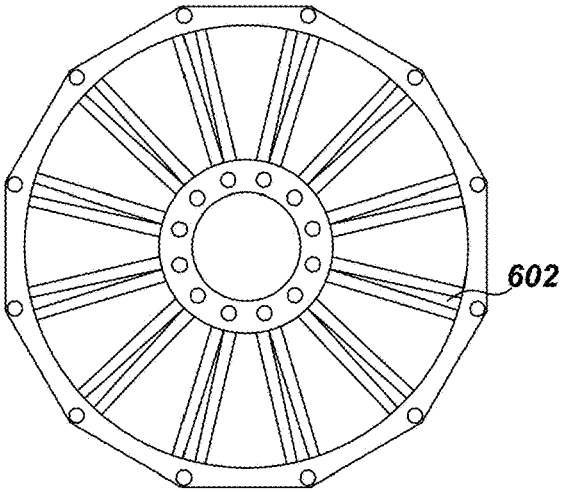
FIG. 6C is an embodiment of a flux sensor, here a printed circuit board (PCB) winding, that is utilized to acquire flux information and estimate torque.

In one embodiment, a flux sensor, such as the PCB winding 602 (shown in FIG. 6C) is installed on an existing magnet-magnet coupling of a bioreactor, or mixer system, to acquire flux information and estimate torque. The flux sensor functions to acquire the speed by relating the measured voltage to the speed of rotation. The voltage, as it changes with time, is measured at various instances. In FIG. 6C, the illustration depicts a PCB winding 602 that picks up the back electro-motive force (EMF).

Figure 8:
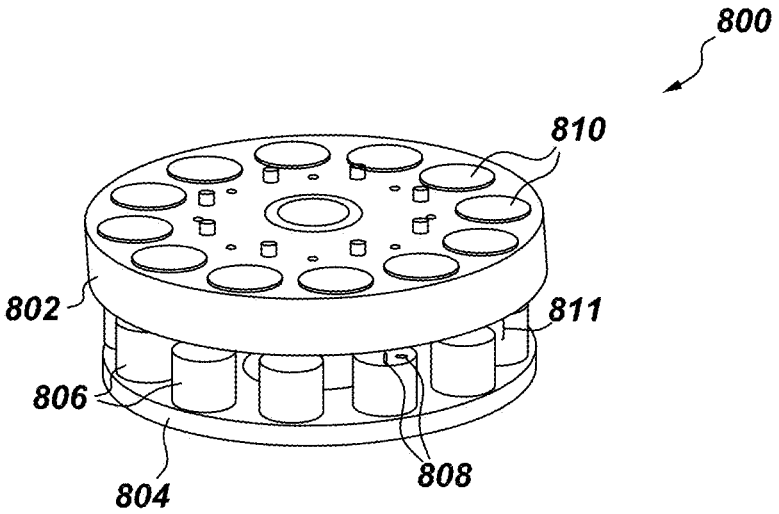
FIG. 8 is an embodiment of bioreactor drive and impeller comprising 12 magnets on each, between which the magnetic flux or the magnetic field density sensor(s) are placed.

In another embodiment, a magnetic field density sensor 808 (e.g., one or more 3D hall-effect based sensors, anisotropic magnetoresistance (AMR), shingled magnetic recording (SMR), giant magnetoresistance (GMR) sensors), and shown in FIG. 8, is installed in the space between the drive and the impeller. The magnetic field density in this space changes as the torque produced by the impeller changes. FIG. 8 depicts a magnet-magnet coupling bioreactor system 800, using integrated sensors 808 to measure the varying viscosity and varying density when the system is in use. Impeller magnets 810 at the impeller end 802 form a first portion and the drive-end magnets 806 incorporate with a base steel plate 804 form a second portion. As depicted, sensors 808, including magnetic field density sensors, are integrated with a drive magnet 806. The sensors, however, may be incorporated, integrated, and/or placed within any region of the system 800. Specifically, the sensors shown are integrated within the region 811 between the impeller-end magnets and the drive-end magnets. The produced torque relates to the fluid properties (e.g., weight, volume, viscosity, density). At speed $n \rightarrow dT/dn$, T is used to identify fluid viscosity, density, and different operating conditions.

Method 2: Measuring Torque and Speed as Related to Axial Flux (AF) Stator

Figure 7:
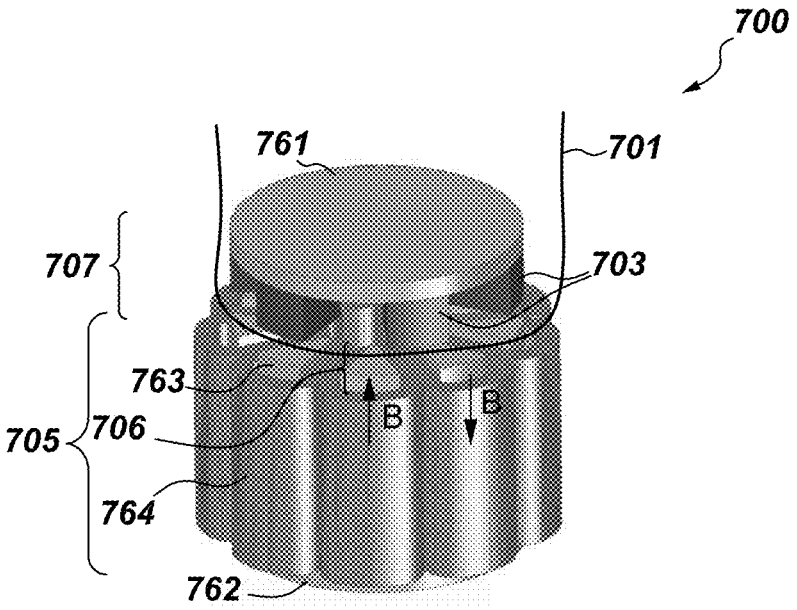
FIG. 7 is a perspective view of an embodiment of an axial flux stator with the magnetic arrangement, and assembled with an impeller portion.

With the axial flux stator, as shown in FIG. 7, the stator voltages and currents are acquired and decomposed to direct and quadrature axis components, and back EMF and torque are calculated without the need for sensors. FIG. 7 illustrates an embodiment of a device 700 having a first rotor portion 707 positioned within a vessel 701, and a second stator portion 705; the second stator portion is a tooth wound axial flux stator 705 that comprises pie-shaped magnetic stator teeth 763 that extend vertically from the stator back iron 762. The stator core can be formed from sintered powdered iron, ferrite, or machined from a coil of magnetic steel. Conductive windings 764 are wound around the stator teeth 763. The conductive windings are divided into phases. Within each phase winding, the field direction of the individual coils alternates so that the application of phase current to the phase winding creates a magnetic field (B) that is directed vertically upward in one tooth and vertically downward in another tooth. The flow of current through the conductive windings forms a magnetic field that flows through the stator teeth, across the air gap, or region 706 between the stator 705 and a rotor 761, interacts with the magnets 703 on the rotor, travels through the rotor 761, and returns through a rotor magnet 703 of opposite magnetic polarity, across the air gap between the stator and rotor, through an oppositely-excited stator tooth, closing through the stator back iron 762.

While Method 1 is described in terms of the magnet-magnet coupling system 800 and can be applied to several different arrangements of drive and impeller, Method 2 is specific for wound stator drive system 700 as shown in FIG. 7. The magnet-magnet coupling system leverages the change in magnetic field density and/or magnetic flux to produce information on the position of the impeller and hence, the produced torque and/or speed. The stator drive system acquires the input current and voltage to the wound stator and relates such information to the produced torque and/or speed.

Figure 9A:
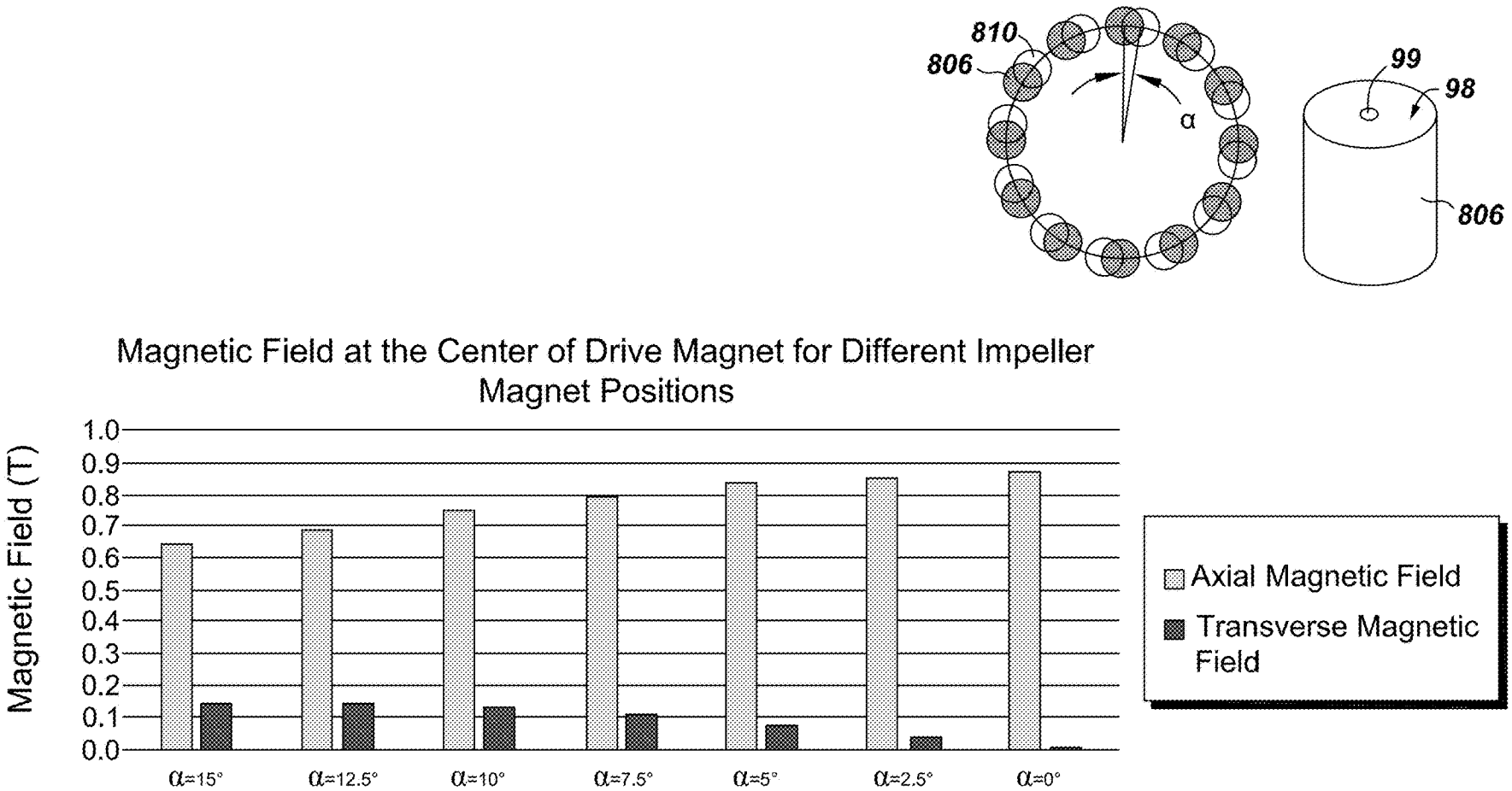
FIG. 9A shows the variation in the axial and the transverse magnetic field densities when measured on the top of the drive magnet, using a magnetic sensor, at different impeller positions.

FIG. 9A shows a comparison of the magnetic field density acquired on the center point 99 of a top surface 98 of one drive magnet 806 (see FIG. 8) for different impeller positions. Impeller positions are recorded as the angle difference between the center line of the impeller magnets 810 and the corresponding center line of the drive magnet 806. The density of the magnetic field is recorded in both axial and transverse directions and it shows significant differences as the impeller-drive angle changes. These values are directly related to the produced torque and are used to deduce the produced torque.

Figure 9B:
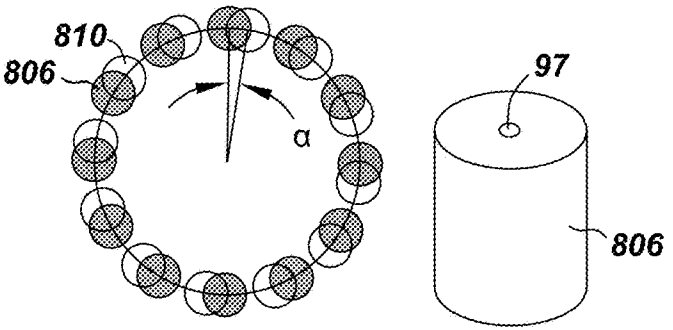
FIG. 9B shows the variation in the axial and the transverse magnetic field densities when measured 0.125" from the top of the drive magnet, using a magnetic sensor, at different impeller positions.
Figure 9B:
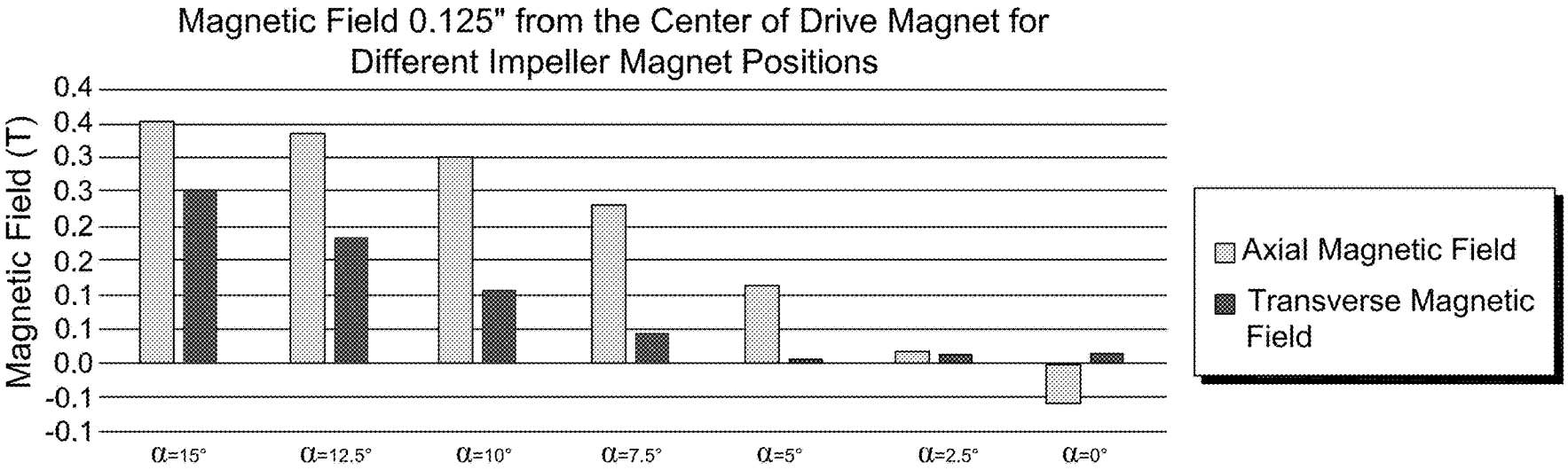

FIG. 9B is similar to figure FIG. 9A with the difference of the point of measurement. Here, the point of measurement 97 is shifted ⅛$^{th}$ of an inch in the axial direction towards the impeller, the point of calculation is 0.125" above the center 99 of the drive magnet 806. Again, the changes in magnetic field density is relative to changes in the impeller magnet 810 position. The sensor position can be anywhere between the drive and the impeller, or even on the bottom surface of the drive or the top surface of the impeller.

Figure 9C:
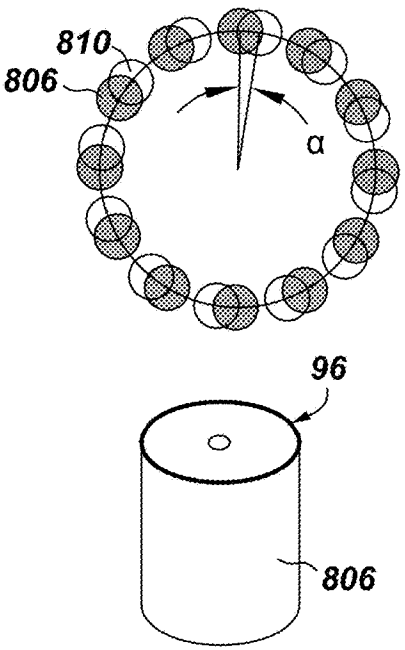
FIG. 9C shows the variation in the magnetic flux when measured by a loop placed on the top circumference of the magnet, using PCB winding or pick-up coil, at different impeller positions.
Figure 9C:
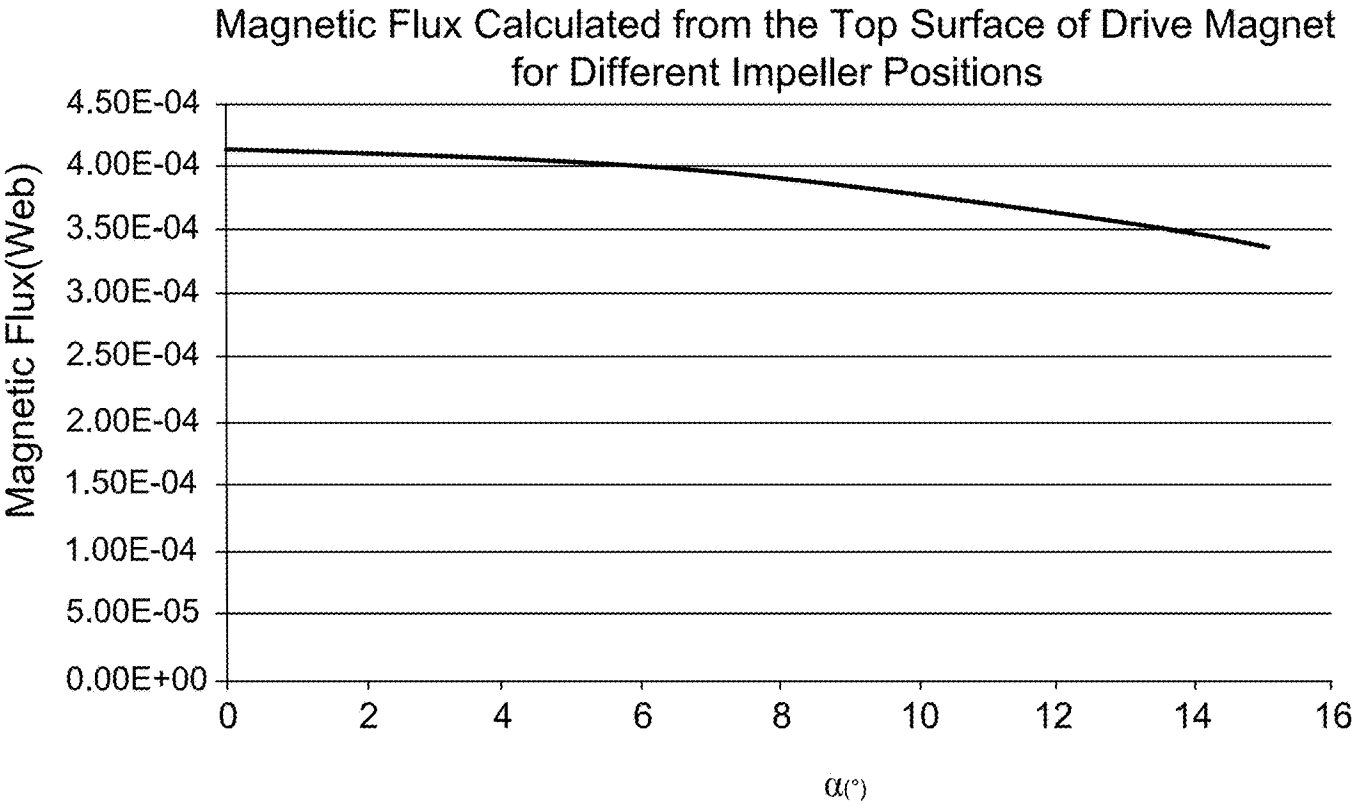

FIG. 9C shows the change in magnetic flux for different impeller positions. It is clear that the magnetic flux can also be used to detect the impeller position and hence the produced torque. Since the flux changes with impeller relative position, it can be used also to detect sudden impeller position, relative to drive, changes. This can be explained using Faraday's law:

$$e = -N\frac{d\phi}{dt}$$

Here, e is the produced voltage in the loop, used to pick-up the magnetic flux, N is the number of turns of the loop, and $\phi$ is the magnetic flux through the loop 96. A change in the impeller relative position causes a sudden change in the loop voltage (since the voltage is related to the time-change on the magnetic flux) and hence, this change in voltage can be related to the change in the impeller relative position. If the impeller speed increases over a certain time (t), then the voltage during this period can be used to calculate the new impeller relative position and speed. If the impeller changes relative position suddenly, due to an abnormal condition, then the voltage waveform is very short in time (more like a pulse) and hence an abnormality behavior can be detected and a subsequent action triggered.

Figure 10:
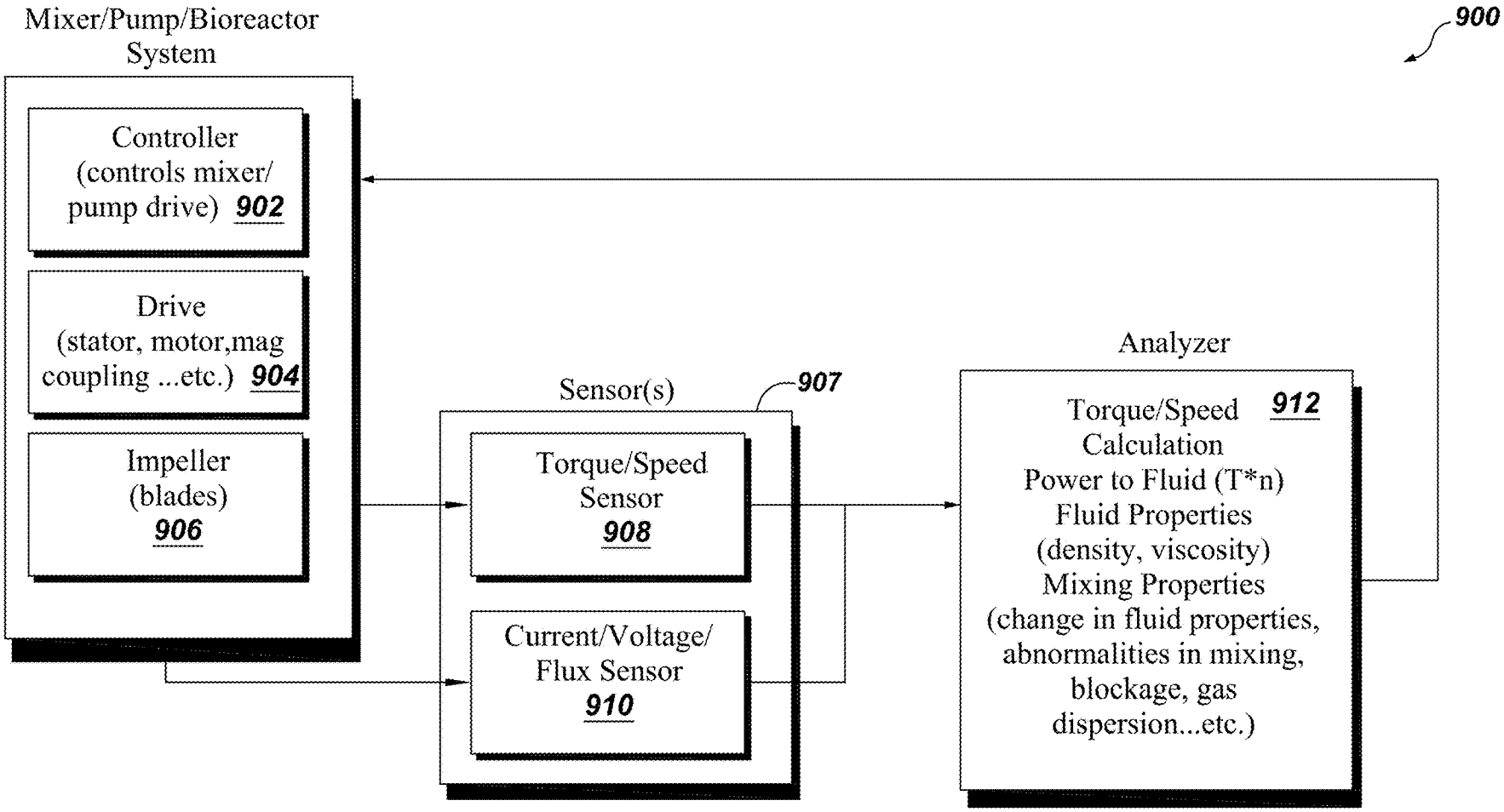
FIG. 10 illustrates an embodiment of the mixing process in a schematic defining the implementation of one or more sensor(s) with the mixing system.

FIG. 10 is a schematic of a mixer system 900. In one aspect, the mixer system is a pump. In another aspect, the mixer system is a bioreactor system. The mixer 900 includes a controller 902; a drive 904 includes a stator, a motor, magnetic coupling, among other components; and an impeller 906 includes one or more blades, among other components. The controller 902 controls the mixer and/or pump drive 904. The drive may include any one of a stator, motor, magnetic coupling, alone or in combination. The sensor arrangement 907 includes a torque-speed sensor 908, a current/voltage/flux sensor 910, alone or in combination. The sensors 907 relay information to a processor 912 which analyzes the torque and speed calculation, analyzes power provided to the fluid, fluid properties (e.g., density, viscosity, etc.), mixing properties (e.g., change in fluid properties, abnormalities in mixing, blockage, gas dispersion, etc.), and other analyses as selected. The processor then provides direction to the controller 902 in a feedback loop. In this manner, the processor is an analyzer that provides precise control of the mixer to increase or decrease agitation, direct power into the system, adjust fluid properties, and correct any deficiencies, abnormalities, or otherwise.

Aspects herein include the assessment of the angle in between the drive and the impeller during mixing operations. This allows for determination of torque, viscosity, and other fluidic properties. This provides a common feature between the dedicated sensor (See FIG. 6C, sensor 602) and the indirect measurement with the axial flux stator.

In one embodiment, the angle in between the drive and the impeller is determined by optical methods such that a marker on the impeller is read by an optical detection system. In such an embodiment, reflecting light from a fiber would allow ease of detection as the impeller is close to the bag bottom and a transparent window can fit with the bag. Other position indicators are possible as well.

In another embodiment, a discrete Hall sensor is utilized. The signal can be processed and compared against the position of the drive, in either a rotating drive or a flux stator. Calibration for a zero torque (offset) case without liquid or other conditions can also be configured. The use of a magnetic field sensor, direct or indirect, can thus be modified and altered in size, shape, and dimension as desired by a user.

Embodiments disclosed herein have several advantages to supersede systems in the field today. Such benefits include detection of fluid viscosity and density, as well as power and torque, delivered to the fluid inside the mixer. Obstructions are detected during start-up, including for example, sediment of micro-carriers, cells or undissolved powder in the bottom of the mixer. Torque measurements enable determination of power transmitted to fluid by actual measurement, in contrast to using solely empirical impeller power number and speed according to Eq. 1), hereby allowing for actual mass transfer determination (e.g., gas transfer calculations). In addition, flooding of the impeller in multiphase systems (e.g., gas sparged bioreactor) can be detected. Changes and any issues in gas sparging can be detected. Correct positioning of the disposable unit, and its impeller, can be verified. Measurement and monitoring of the different properties can also be used for the process analytical tool (PAT).

Embodiments further address the challenges and issues that arise in the field. Determination of power delivered to the fluid is currently performed with formulas or look-up tables and not directly measured. Fluid density and/or viscosity changes as the mixing process takes place, thus, updated values provide accurate control of the mixing process. Abnormalities in mixing process, such as blockage, obstacles, or issues with gas sparging, may also be determined to ensure quality of the mixing process. These features detect and flag such issues, possibly even providing an alarm, so that the mixing process can be corrected.

Embodiments disclosed herein provide additional functionalities to the user of the bioreactor or mixer, as desired. Various embodiments allow accurate monitoring of the power delivered to the fluid while mixing, and allow continuous updates on the fluid properties, including alarms in cases of abnormalities in mixing. Such embodiments may be modified so as to encompass features and components such as temperature, pressure, and other measurable conditions. The embodiments and aspects disclosed herein may be incorporated with any size, shape, and dimension of vessel, bag, mixing container or otherwise.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects.

This written description uses examples to disclose the various embodiments, and also to enable a person having ordinary skill in the art to practice the various embodiments, including making and using any devices or systems and performing any incorporated methods. The patentable scope of the various embodiments is defined by the claims, and may include other examples that occur to those skilled in the art. Such other examples are intended to be within the scope of the claims if the examples have structural elements that do not differ from the literal language of the claims, or the examples include equivalent structural elements with insubstantial differences from the literal languages of the claims.

The invention claimed is:

1. A magnetic mixing system to characterize conditions in a fluid mixing device, the system comprising:

a mixer vessel comprising a fluid;

a drive that creates a magnetic field;

a controller that operates the drive;

one or more magnet sensors configured to detect the magnetic field or a magnetic flux, and positioned with the system to detect the magnetic field or the magnetic flux; and a processor receiving information from the one or more magnetic sensors, the processor configured (1) to calculate at least the torque and speed delivered in mixing the fluid, (2) to use the calculated torque and speed to continuously calculate a power delivered to the fluid inside the mixer vessel while mixing the fluid, (3) to continuously characterize at least one of: a plurality of fluid and mixing properties, a plurality of mixing conditions, and a plurality of abnormalities while mixing the fluid, and (4) to provide direction to the controller based on at least one of: the continuous calculation and the continuous characterization.

2. The magnetic mixing system of claim 1, further comprising an impeller inside the vessel, wherein the drive creates the magnetic field to rotate the impeller and the one or more magnet sensors measure the magnetic field or the magnetic flux provided to the impeller.

3. The magnetic mixing system of claim 2, wherein the one or more magnet sensors are positioned with the drive, the impeller, or between the impeller and the drive.

4. The magnetic mixing system of claim 1, wherein the one or more magnet sensors further detect current and voltage provided to the drive.

5. The magnetic mixing system of claim 1, wherein the drive is a stator, or the drive includes a set of permanent magnets in combination with a motor.

6. The magnetic mixing system of claim 1, wherein the drive is a stator, motor, or magnetic coupling, and the one or more magnet sensors are transducers positioned therewith, respectively, alone or in combination.

7. The magnetic mixing system of claim 1, wherein the torque and speed of the impeller corresponds to the torque and speed delivered in mixing the fluid.

8. The magnetic mixing system of claim 1, wherein the processor uses the power, torque or speed, alone or in combination, with one or more fluidic properties to assess real-time mixing conditions and mixing properties.

9. The magnetic mixing system of claim 8, wherein the processor detects a change in the fluidic properties, mixing conditions, or mixing properties, individually or in combination.

10. The magnetic mixing system of claim 1, wherein the plurality of abnormalities comprises abnormalities in the fluid properties, mixing conditions, or mixing properties and the processor detects the plurality of abnormalities as determined by learned patterns or predetermined threshold values.

11. The magnetic mixing system of claim 1, wherein the plurality of fluid and mixing properties include density and viscosity of the fluid.

12. The magnetic mixing system of claim 11, wherein the processor is configured to detect abnormalities in the density or viscosity of the fluid, in the power, torque, or speed, alone or in combination.

13. The magnetic mixing system of claim 1, wherein the processor is configured to detect blockage, gas dispersion, or one or more contaminants in the fluid, alone or in combination.

14. The magnetic mixing system of claim 1, wherein the processor comprises an analyzer that provides the direction to the controller in a feedback loop.

15. The magnetic mixing system of claim 14, wherein the analyzer directs power to the drive to increase or decrease agitation, to adjust fluidic properties, and correct any deficiencies or abnormalities, individually or in combination.

16. A magnetic mixing system comprising:

a mixer vessel comprising a fluid;

a drive including one or more drive magnets that create a magnetic field;

a controller that operates the drive;

one or more magnet sensors configured to detect the magnetic field or a magnetic flux and positioned with at least a portion of the drive, with at least a portion of the impeller, or in a space between the impeller and the drive, alone or in combination, wherein the position of the one or more magnet sensors is selected to detect the magnetic field or a magnetic flux; and a processor receiving information from the one or more magnet sensors, the processor configured (1) to calculate at least the torque and speed delivered in mixing the fluid, (2) to use the calculated torque and speed to continuously calculate a power delivered to the fluid inside the mixer vessel while mixing the fluid, (3) to continuously characterize at least one of: a plurality of fluid and mixing properties, a plurality of real-time mixing conditions, and a plurality of abnormalities while mixing the fluid, and (4) to provide direction to the controller based on at least one of: the continuous calculation and the continuous characterization.

17. The magnetic mixing system of claim 16, wherein the one or more magnet sensors detect the fluidic properties and alignment of the magnetic field, individually or in combination.

18. A method of controlling conditions in a fluid mixing device, the method comprising the steps of:

providing a fluid mixing device having a mixer vessel comprising a fluid, a drive that creates a magnetic field, a controller that operates the drive, one or more magnet sensors, and a processor, wherein the one or more magnet sensors are configured to detect the magnetic field or a magnetic flux;

detecting, by way of the one or more magnet sensors, at least one of a magnetic field, a magnetic flux, power provided to the fluid, torque, speed, current, or voltage;

calculating power, torque and speed delivered in mixing the fluid, if not previously detected;

analyzing, by way of the processor, using the power, torque and speed to continuously characterize at least one of: a plurality of fluid and mixing properties, a plurality of mixing conditions, and a plurality of abnormalities while mixing the fluid; and controlling the power, torque, and speed delivered to the fluid based on the continuous characterization.

19. The method of claim 18, wherein the mixing system further comprises an impeller and the step of detecting includes detecting a position of the impeller.

20. The method of claim 18, wherein the step of analyzing includes detecting a change in the fluidic properties.

21. The method of claim 18, wherein the power, torque, speed, current, voltage, fluidic properties, mixing conditions, and mixing properties, alone or in combination, are displayed at a user-interface.

22. The method of claim 21, wherein the power, torque and speed are determined directly, without user manipulation.

23. The method of claim 18, wherein the fluidic properties comprise fluid composition, density, and viscosity, alone or in combination, provided to the processor by way of the one or more magnet sensors.

24. The method of claim 18, further comprising a step of identifying abnormalities in the fluid mixing device, the fluidic properties, the mixing conditions, and the mixing properties.

25. The method of claim 18, wherein the processor is an analyzer that provides feedback to the controller to automatically control the power, torque, and speed delivered to the drive.

26. The method of claim 25, wherein the processor provides a predetermined composition, viscosity and density of the fluid, alone or in combination.

27. The method of claim 26, wherein the processor provides information to the controller that determines an optimal composition, viscosity, and density as based on a change in the fluidic properties.

28. The method of claim 18, wherein the one or more magnet sensors detect an angle between the drive and the impeller during operation of the fluid mixing device in order to determine the fluidic properties.

* * * * *